United States Patent [19]

Scott

[11] Patent Number: 4,809,367

[45] Date of Patent: Mar. 7, 1989

[54] CISTERN FLUSHING APPARATUS

[75] Inventor: Errol R. Scott, Transvaal, South Africa

[73] Assignee: Partall Systems (Proprietary) Limited, Transvaal, South Africa

[21] Appl. No.: 74,671

[22] Filed: Jul. 17, 1987

[30] Foreign Application Priority Data

Aug. 8, 1986 [ZA] South Africa ..... 86/5978

[51] Int. Cl.[4] ..... E03D 1/14

[52] U.S. Cl. ..... 4/324; 4/407; 251/321

[58] Field of Search ..... 4/324, 381, 384, 407, 4/325, 326, 408; 251/321-324; 137/636, 625.18

[56] References Cited

U.S. PATENT DOCUMENTS 3,421,161 1/1969 Stafford et al. .

3,466,674 9/1969 Schroder ..... 4/407

3,918,105 11/1975 Young ..... 4/326

FOREIGN PATENT DOCUMENTS

73/8242 3/1975 South Africa .

75/0671 9/1975 South Africa .

*Primary Examiner*—Stephen Marcus

*Attorney, Agent, or Firm*—Birch, Stewart, Kolasch & Birch

[57] ABSTRACT

A cistern flushing apparatus of the kind which comprises an upright stem carrying a closure member at its lower end which, in a first position of the stem, seats on a cistern outlet and which, in a second position of the stem, is raised off the outlet to permit flushing to take place. The stem is held in its second position by a float-controlled arm which releases the stem to return to its first position with a predetermined volume of flush has taken place. The stem is raised by water at mains pressure.

6 Claims, 5 Drawing Sheets

Fig. 5.
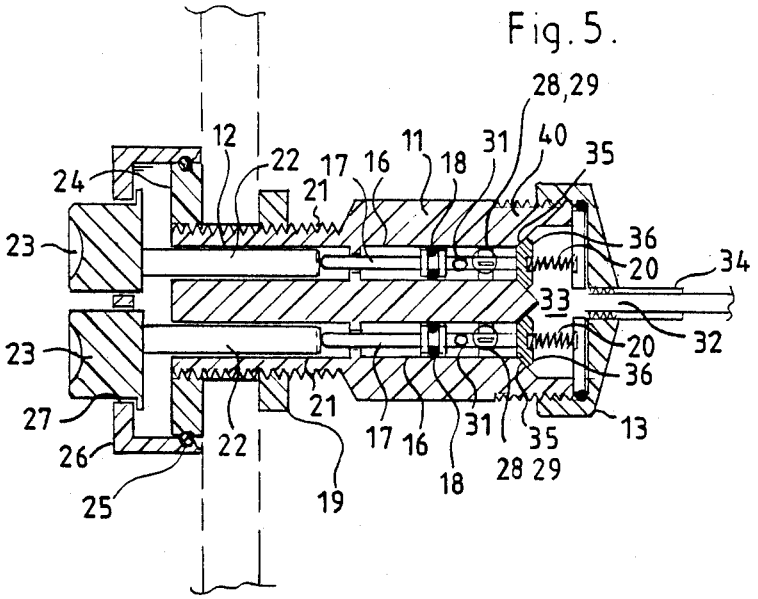
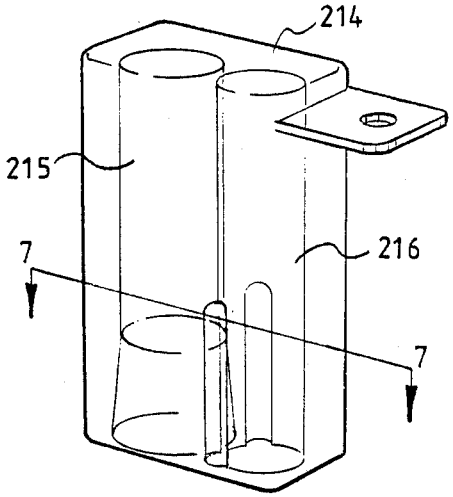
Fig. 6.
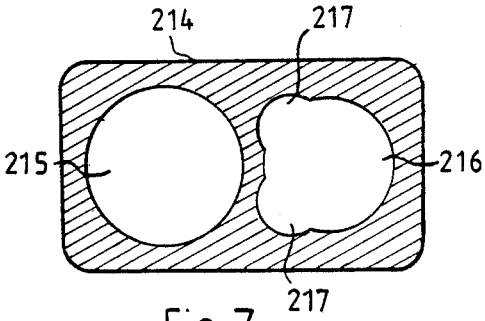
Fig. 7.

CISTERN FLUSHING APPARATUS

BACKGROUND TO THE INVENTION

1. Field of the Invention

This invention relates to a cistern flushing apparatus.

2. Description of Background Art

Cistern flushing systems are known in which a valve stem carries a closure member which is normally seated upon an outlet from the cistern. The valve stem is raised by an operating system to unseat the closure member from the outlet to permit flushing liquid to leave the cistern through the outlet, and the stem is held in its raised position by the action of a float arm. When the liquid level in the cistern drops to a certain level the float arm drops and ceases to act upon the stem with the result that the stem drops under gravity and reseats the closure member to end the flush.

A further known development to a system of the kind first specified provides the operator with a choice between different flush volumes. In this case there are two float arms at different levels. The operating system permits the stem selectively to be raised to two different heights. When the stem is raised to the lower of the two heights, it is only acted upon and held up by the upper of the float arms. When a partial flush only has taken place, the stem is released by the float arm with resultant dropping of the stem and reseating of the closure member on the outlet. On the other hand, when the stem is raised to the higher of the two heights, it is acted upon by the lower float arm which only releases it to drop down and reseat the closure member when a full flush has taken place.

A typical example of a system of the kind second specified is described in South African patent No. 75/0671. All the known operating systems make use of rotatable operating levers and appropriate linkages to achieve raising of the valve stem and unseating of the closure member to commence the flush. The present inventor has encountered difficulties with such systems, primarily caused by sticking of the operating lever(s).

It is an object of the present invention to provide a cistern flushing apparatus which has a different kind of operating system.

SUMMARY OF THE INVENTION

According to the present invention, there is provided a cistern flushing apparatus of the kind locatable in a cistern and comprising:

(a) an operatively upright stem;

(b) a closure member at the operatively lower end of the stem which is adapted, in a first, lower position of the stem, to seat on and close an outlet from the cistern and in a second, raised position of the stem, to clear the outlet and permit liquid to flush out of the cistern through the outlet;

(c) means which are movable to raise the stem from its first position to its second position; and (d) float controlled means which serve, when the stem is raised to its second position, to hold it in that position until such time as a predetermined volume of liquid has flushed out of the cistern and which then permit the stem to return to its first position;

wherein the means which are movable to raise the stem from its first position to its second position are arranged to be moved by a pressurized liquid.

Preferably, the stem has two second positions each corresponding to a different volume of flush and the movable means are movable selectively to raise the stem to a selected one of its second positions. With this arrangement, it is possible to select one of two different flush volumes.

In a convenient form of the invention, the movable means are arranged to be moved by water at mains pressure.

The movable means may comprise a body connected to the stem, the body being raisable by water at mains pressure thereby to raise the stem. The movable means may further comprise spaced, blind bores in the body spaced standpipes arranged to vent into the blind ends of the bores and to be supplied selectively with water at mains pressure, the body being slidable on the standpipes and being adapted to rise when one or other of the standpipes is supplied with water at mains pressure.

The blind bores may be so shaped that when one of the standpipes is supplied with water at mains pressure, the body rises to a lower elevation than it does when the other standpipe is supplied with water at mains pressure. Preferably, the cross-sectional area of each of the blind bores is constant for a portion thereof towards its blind end, such portion of constant cross-sectional area being a snug slide fit on the corresponding standpipe. Preferably also the cross-sectional area of a portion of each of the blind bores located away from the blind end and towards the mouth of the bore is of greater cross-sectional area than the portion of constant cross-sectional area and also greater than the cross-sectional area of the standpipe. There is a transition in each blind bore between the portions of constant and greater cross-sectional area, the transitions in the two bores being at different elevations.

The apparatus of the invention may also include a push-button control valve assembly operable to supply water at mains pressure to a selected one of the standpipes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 shows a detail of the control valve assembly;

FIG. 6, shows a view in elevation of a slightly modified cap member; and

FIG. 7 shows a cross-section at the line 7—7 in FIG. 6.

DESCRIPTION OF A PREFERRED EMBODIMENT

Figure 1:
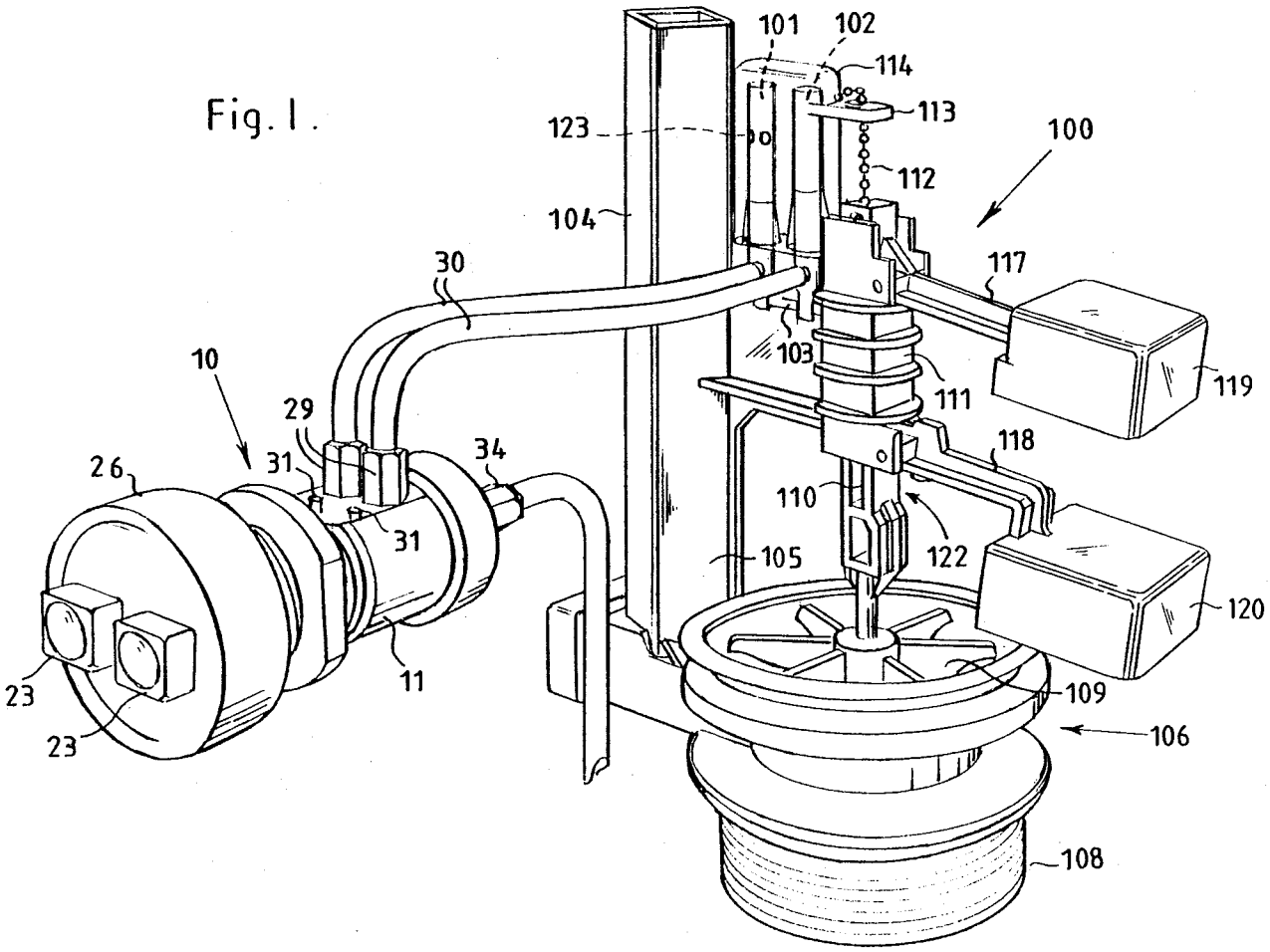
FIG. 1 shows a perspective view of a cistern flushing apparatus according to the invention.

The flushing apparatus illustrated in FIGS. 1 to 5 has two main assemblies, designated 10 and 100 in the Figures. The control valve assembly 10 comprises the control valves and the flushing assembly 100 comprises the actual flushing valve arrangement.

The assembly 10 will be described first, primarily with reference to FIG. 5. It includes a housing 11 which is threaded at its ends 12 and 40. The end 40 is fitted with a threaded cap 13 which is sealed with respect to the housing by means of a seal 14. The interior of the housing is formed with two spaced passages 16 in which plungers 17 are slidable. Each plunger 17 carries an O-ring 18 which makes sealing contact with the wall of the passage 16. Between one end of each plunger 17 and the end of the passage 16 is a helical compression spring 20. The opposite end of each plunger protrudes into a passage 21 of which two are formed, coaxially with the passages 16, in the threaded end 12 of the housing 11. Extending into the passages 21 are extensions 22 of square push-buttons 23. A collar 24 is threaded onto the threaded end 12 of the housing 11, the periphery of this collar being grooved to take an O-ring 25. There is another collar 19 threaded onto the end 12 inwardly of the collar 24. A cap 26 has two square holes 27 which receive the square buttons 23 and the interior of its mouth is recessed as shown in FIG. 5 to enable the cap to be pressed over the O-ring 25 in a secure clip fit.

Each passage 16 is intersected by a first port 28 carrying a nipple 29 to which the end of a flexible hose 30 is connected. Each passage 16 is also intersected by a second bleed port 31, spaced from the port 28, which extends to the periphery of the housing 11.

There is a further port 32 which extends through the cap 13 and which communicates with both passages 16 via a chamber 33. The port 32 has a nipple 34 connected to it. In use, a suitable conduit is connected to the nipple 33, this conduit being connected in turn to the water mains.

The plungers 17 carry sealing elements 36. The springs 20 bias the plungers 17 to the position seen in FIG. 5, in which position the sealing elements 36 make sealing contact with shoulders 35 at the ends of the passages 16, thereby preventing mains water from entering the ports 28. However, when the relevant button 23 is pushed inwardly, the plunger 17 moves against the spring bias to unseat the seating element 36 from the shoulder 35, thereby permitting mains water to flow from the chamber 33 to the port 28. When the button is pushed fully home, the plunger 17 moves far enough for the O-ring 18 to pass the bleed port 31, thereby preventing mains water from leaving the relevant passage 16 via that port.

Each flexible hose 30 extends from the assembly 10 to the assembly 100 where its opposite end is connected to a nipple communicating with the interior of a hollow standpipe in the form of a tube 101 or 102. The tubes 101 and 102 are mounted side-by-side at an upright attitude on a cross-bar 103 extending from a hollow post 104 forming part of the assembly 100.

Figure 2:
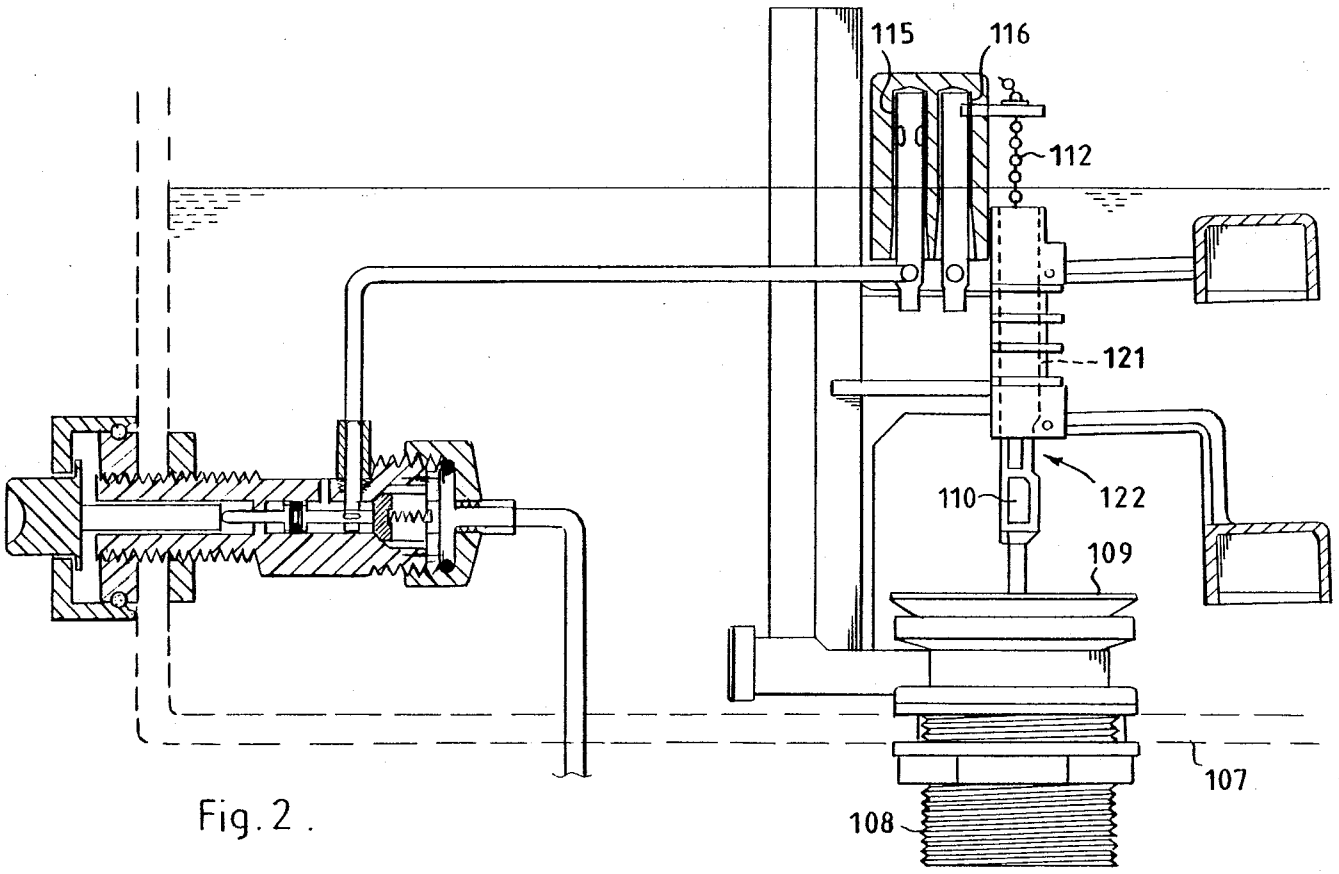
FIG. 2 shows a cross-sectional view through the apparatus before a flush commences.

The hollow lower end 105 of the post 104 is connected to a tubular outlet 106 which is fitted at the bottom of a cistern shown partially at 107 in FIG. 2. The outlet 106 is open at top and bottom, the bottom 108 being threaded for the connection thereto of a conduit leading to a toilet bowl in the conventional way.

A flexible closure member 109 closes off the open top of the tubular outlet 106 and is carried at the lower end of a stem 110 which slides vertically in a housing 111 carried at the end of the cross-bar 103. The upper end of the stem 110 has a short chain 112 connected to it, the opposite upper end of the chain being connected to an arm 113.

Figure 3:
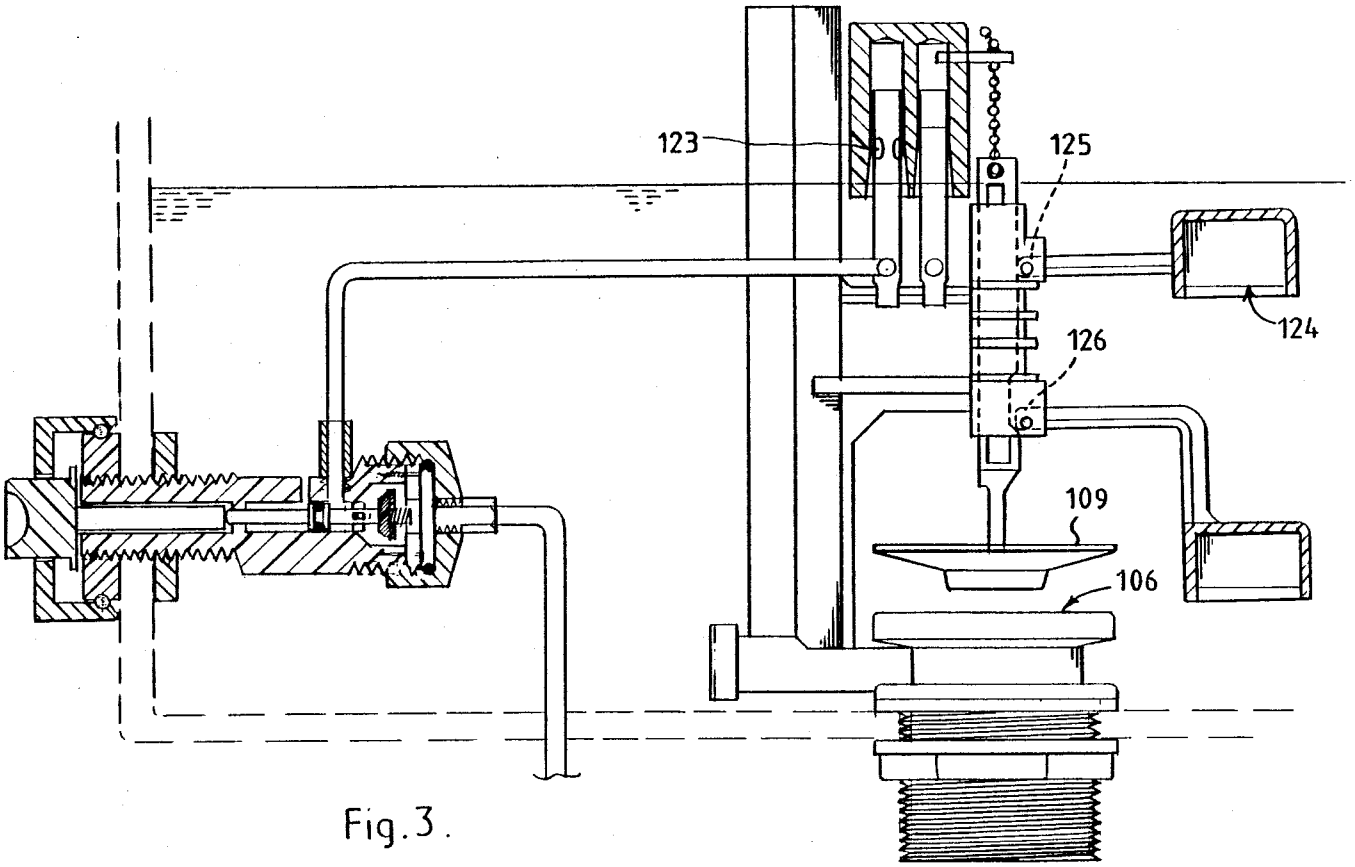
FIG. 3 shows a cross-sectional view through the apparatus during a part flush.
Figure 4:
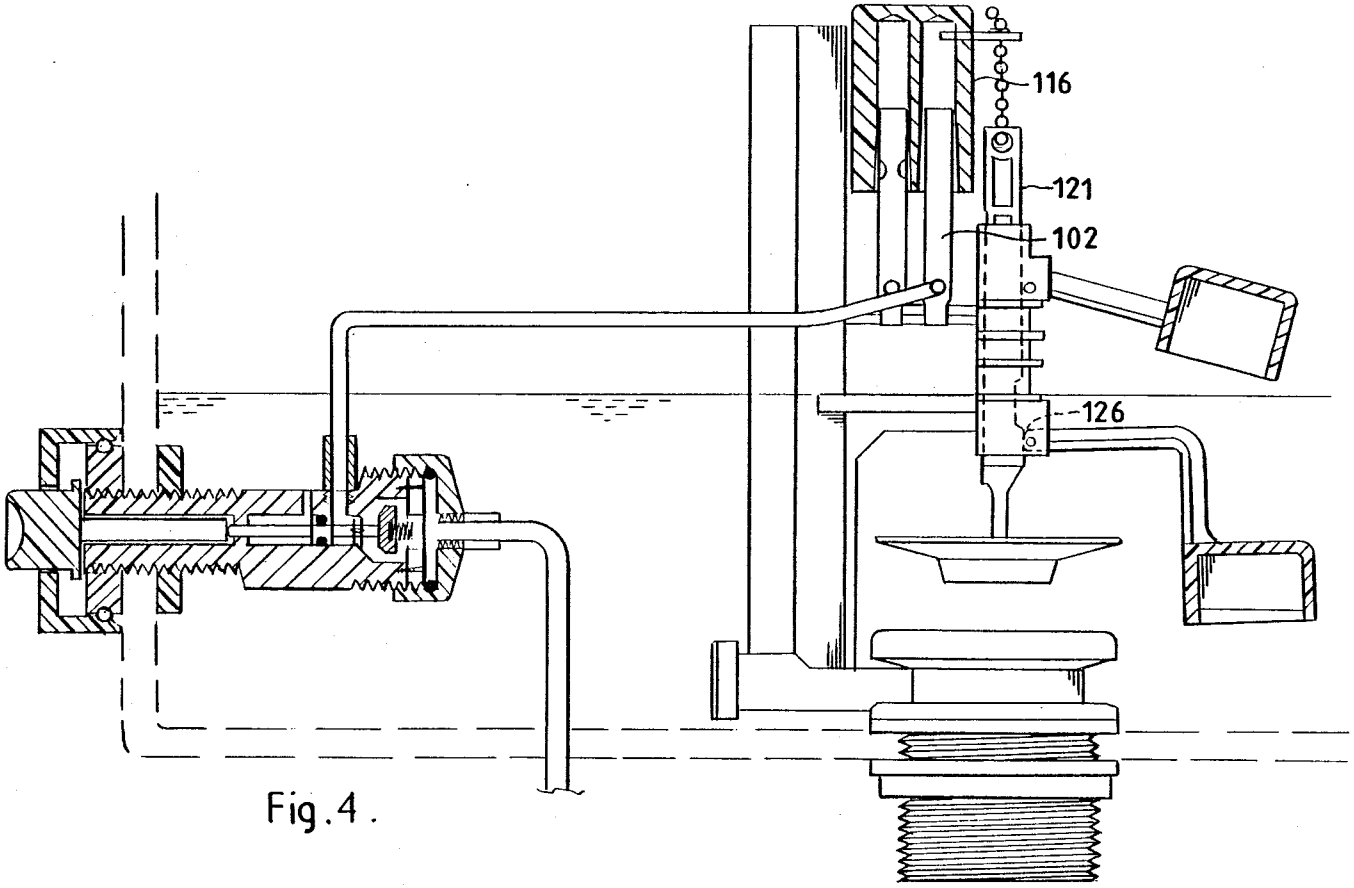
FIG. 4 shows a view similar to that of FIG. 3, but during a full flush.

The arm 113 is connected to the upper end of a cap member 114 which is formed internally with spaced, blind bores 115 and 116. The upper part of each blind bore 115, 116 is of constant diameter, while its lower end is outwardly flared to form the conical shape as shown in FIGS. 2 to 4. Examination of FIGS. 2 to 4 indicates that the constant diameter upper part of the bore 115 is longer than the corresponding part of the bore 116 and hence that the conical part of the bore 115 is shorter than that of the bore 116. The upstanding tubes 101 and 102 are snug slide fits in the constant diameter parts of the bores 115 and 116 respectively.

FIGS. 2 to 4 indicate that the upstanding tube 101 is formed with a series of holes 123 through its wall approximately two-thirds of the way up its height. The upper ends of the tubes 101 and 102 are open and their bottom ends are closed.

Two float arrestor arms 117 and 118 are pivoted to the housing 111, each arm carrying an inverted, cup-shaped float 119, 120 towards its outer end. The stem 110 has a generally planar face 121 except that, towards its lower end, there is a recess 122.

The operation of the described system is as follows, assuming that the nipple 34 is connected up to the mains and assuming that the cistern is full of water. One of the buttons 23 is marked "part" and one is marked "all". When a partial flush is to take place, the "part" button is pushed in to unseat the relevant sealing element 36 from its shoulder 25, thereby establishing a water flow path along the relevant hose 30 leading to the upstanding tube 101. No water flows through the other hose 30 because the other sealing element 36 remains seated upon its shoulder 35.

The water enters the upstanding tube 101 at mains pressure and fills the space in the bore 115 above the upper end of the tube 101. The pressure of the water lifts the cap member 114 upwardly until such time as the holes 123 in the wall of the tube 101 are aligned with the beginning of the conical part of the bore 115. There is now an escape route for water which flows downwardly into the cistern. This situation is depicted in FIG. 3 which shows that the stem 110 has been raised to unseat the closure member 109 from the outlet 106. During this operation, the float 119 at the end of the arm 117 is kept in an elevated position by virtue of the pocket of air 124 which is trapped inside it. The lifting of the cap member 114 ceases when the holes 123 are aligned with the beginning of the conical part of the bore 115 because water entering the tube 101 flows out downwardly rather than out of the top of the tube.

Water now flushes out of the cistern into the toilet bowl through the outlet 106 and the water level in the cistern drops rapidly.

The above actions occur as soon as the "part" button is pushed in. When the button is released by the user, it returns to the FIG. 5 position under the influence of the spring 20. In this position, back-pressure in the hose 30 is relieved by virtue of the fact that water can flow back down the hose 30, into the passage 16 and outwardly through the bleed port 31 into the cistern. Because the pressure at the upper end of the tube 101 is relieved, the cap member 114 drops down again, slackening the chain 112.

However, the elevated position of the float 119 ensures that the stem 110 cannot drop down because the inner end 125 (FIG. 3) of the arrestor arm 117 bears upon the planar face 121 thereof and jams the shaft in position in the housing 111.

As soon as the water level in the cistern drops to the level of the bottom of the float 119, its buoyancy is lost and the float drops, pivoting the arrestor arm 117 downwardly as it does so. The inner end 125 of the arrestor arm frees the planar face 121 of the stem which promptly drops down to reseat the closure member 109 on the outlet 106. The "part" flush is over. The cistern is refilled in the conventional manner.

In practice, the float 119 is situated so that approximately half of the full volume of water contained in the cistern is flushed during the "part" flush described above.

It will be noted that, during the "part" flush operation described above, the float 120 has no effect on the stem 110 because its inner end 126 is located opposite the recess 122 and hence does not contact the shaft.

Assuming that the cistern is now full again, and it is desired to have a complete or full flush, the "all" button is pushed in. The initial sequence of events described above takes place, with the mains water in this case entering the other blind bore 116 to lift the cap member 114 upwardly and raise the stem 110, thereby unseating the closure member 109.

However in this case, the cap member 114 will be lifted much higher than in the "part" situation. In fact, the cap member 114 will be lifted until such time as the upper end of the tube 102 is aligned with the beginning of the conical part of the bore 116 as depicted in FIG. 4. The mains water entering the bore 116 escapes downwardly into the cistern and a similar pressure relief operation to that described previously takes place when the "all" button is released. As in the previous case, the unseating of the closure member 109 results in the cistern water escaping rapidly into the toilet bowl. During this "all" flush, both floats 119 and 120 are elevated, as in the previous "part" case, by the pockets of air which are trapped by the floats.

When the cistern water level drops to the bottom of the float 119, that float loses buoyancy and drops so that the inner end 125 of the arm 117 releases the stem 110. The stem 110 is, however, still not able to drop. This is because the stem 110 is lifted high enough for the inner end 126 of the arm 118 to bear upon the shaft below the recess 122, thereby jamming the shaft in position as shown in FIG. 4. The float 120 remains buoyant. The water level in the cistern therefore continues to drop until the level reaches the bottom of the float 120 to cause it to lose buoyancy. This float then drops and the inner end 126 of the arm 118 releases the shaft 110, enabling it to fall rapidly to reseat the closure member 109 on the outlet 106. The "all" flush is over.

In practice, the float 120 will be situated close to the bottom of the cistern so that substantially the entire contents of the cistern are flushed into the toilet bowl during the "all" flush just described.

It will be noted that the upstanding tube 102 provides guidance for the cap member 114 when the "part" flush takes place. In similar fashion, the upstanding tube 101 provides guidance for the cap member 114 when the "all" flush takes place. Thus guided motion of the cap member 114 is ensured in both cases.

The control valve assembly of the system is mounted to the front wall of the cistern with the buttons for "part" and "all" in readily accessible positions. The manner in which this mounting is done is described in detail in a copending patent application filed simultaneously with the present application.

In FIGS. 6 and 7, a slightly modified form of cap member 214 has blind bores 215 and 216. The bore 215 is identical to the bore 115. The bore 216 does not have a conically flaring lower part. Instead, the lower part of the bore 216 is increased in cross-sectional area by the provision of two grooves 217. Clearly, this embodiment of cap member will work in the same way as that illustrated in the preceding figures. The advantage of the embodiment of FIGS. 6 and 7 when compared to that of the preceding Figures is the fact that the bore 216 will maintain a better slide fit on the relevant tube during its upward travel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cistern flushing apparatus for mounting within a cistern comprising:

an operatively upright stem movable between a first, lower position, and second and third raised positions;

a closure member at the lower end of the stem for closing an outlet from a cistern when the stem is in its first position and for opening the outlet when the stem is in its second or its third position to permit liquid to flush from the cistern through the outlet;

a cap member having first and second spaced blind bores therein;

a flexible tie member for operatively connecting said cap member to the stem;

fixed first and second spaced standpipes, said first and second blind bores being slidably mounted on said first and second spaced standpipes, respectively;

valve means operable selectively to supply liquid under pressure to the first standpipe or the second standpipe, the liquid venting from the relevant standpipe into the relevant blind bore and serving to raise the cap member and hence the stem to its second position or its third position depending on whether the liquid is supplied to the first standpipe or the second standpipe; and first and second float controlled means operating independently of the cap member and serving respectively to hold the stem in its second position or its third position until such time as a predetermined first or second volume of liquid respectively has flushed from the cistern through the outlet and thereafter to release the stem so that it descends under gravity for the closure member to close the outlet;

wherein the first blind bore is slidably mounted on the first standpipe and serves to guide the cap member in a stable fashion as the cap member is raised by liquid venting from the second standpipe and wherein the second blind bore is slidably mounted on the second standpipe and serves to guide the cap member in a stable fashion as the cap member is raised by liquid venting from the first standpipe.

2. The cistern flushing apparatus according to claim 1, wherein the first and second blind bores each have a cross-sectional area which is constant over a portion thereof towards the blind end of the bore and a portion of greater cross-sectional area over a portion thereof towards the mouth of the blind bore, the portion of constant cross-sectional area being of greater length in the case of the first blind bore than in the case of the second blind bore.

3. The cistern flushing apparatus according to claim 2, wherein the portions of constant cross-sectional area of the blind bores slide snugly on the standpipes, the first standpipe locating in the portion of constant cross-sectional area of the first blind bore throughout venting of liquid from the second standpipe and the second standpipe locating in the portion of constant cross-sectional area of the second blind bore throughout venting of liquid from the first standpipe, the location of either standpipe in the relevant portion of constant cross-sectional area serving to stabilize the cap member.

4. The cistern flushing apparatus according to claim 3, wherein the first standpipe is arranged to vent liquid through its top and through holes in the first standpipe located below the top thereof, raising of the cap member by liquid venting from the first standpipe ceasing when the holes in the first standpipe are aligned with the transition between the portions of the first blind bore of constant and greater cross-sectional area.

5. A cistern flushing apparatus according to claim 4, wherein the second standpipe is arranged to vent liquid only through its top, raising of the cap member by liquid venting from the second standpipe ceasing when the top of the second standpipe is aligned with the transition between the portions of the second blind bore of constant and greater cross-sectional area.

6. A cistern flushing apparatus according to claim 1, wherein the valve means is operable to terminate the supply of liquid to the selected standpipe and wherein the valve means includes a bleed permitting liquid to drain out of the selected standpipe and the relevant blind bore such that the cap member is thereafter able to descend under gravity from its raised position to a reset position prior to the first or the second float controlled means releasing the stem for the closure member to reclose the outlet under gravity.

* * * * *